US011047176B2

(12) United States Patent
Breivik et al.

(10) Patent No.: US 11,047,176 B2
(45) Date of Patent: Jun. 29, 2021

(54) METHOD AND DEVICE TO SUPPLY LIQUID TO A DRILL PIPE

(71) Applicant: MOONSHINE SOLUTIONS AS, Bergen (NO)

(72) Inventors: Alf Breivik, Ulvik (NO); Helge Hope, Bergen (NO)

(73) Assignee: MOONSHINE SOLUTIONS AS, Bergen (NO)

( * ) Notice: Subject to any disclaimer, the term of this patent is extended or adjusted under 35 U.S.C. 154(b) by 29 days.

(21) Appl. No.: 16/482,551

(22) PCT Filed: Jan. 31, 2018

(86) PCT No.: PCT/NO2018/000004
§ 371 (c)(1),
(2) Date: Sep. 27, 2019

(87) PCT Pub. No.: WO2018/143817
PCT Pub. Date: Aug. 9, 2018

(65) Prior Publication Data

US 2020/0024910 A1 Jan. 23, 2020

(30) Foreign Application Priority Data

Jan. 31, 2017 (NO) ..... 20170146

(51) Int. Cl.
*E21B 17/04* (2006.01)
*E21B 19/16* (2006.01)
*E21B 17/18* (2006.01)

(52) U.S. Cl.
CPC ..... *E21B 17/04* (2013.01); *E21B 17/18* (2013.01); *E21B 19/16* (2013.01)

(58) Field of Classification Search
CPC ..... E21B 21/01; E21B 21/013; E21B 21/02; E21B 17/04; E21B 17/18; E21B 19/16;
(Continued)

(56) References Cited

U.S. PATENT DOCUMENTS 6,779,599 B2 8/2004 Mullins et al.
2004/0000405 A1 1/2004 Fournier, Jr. et al.
(Continued)

FOREIGN PATENT DOCUMENTS

EP 0995011 A1 4/2000
EP 0995011 B1 11/2002
(Continued)

OTHER PUBLICATIONS

Supplementary European Search Report, EP 18 74 8563, Place of Search: Munich, Date of Completion of the Search: Oct. 9, 2020.
(Continued)

*Primary Examiner* — Brad Harcourt
(74) *Attorney, Agent, or Firm* — Flener IP & Business Law; Zareefa B. Flener

(57) ABSTRACT

It is discussed a method for drilling a well through a formation from a drilling installation, for the recovery of fluids, where a drill pipe (30) made up of a number of drill pipe sections is lead down into the formation and is supplied with liquid fluid from a fluid delivery system before one or more new drill pipe sections connected to the installations drill floor successively is screwed onto the upper end of the drill pipe (30), where a filling pipe (110) formed with a downwardly extending pipe spigot (17) that is lead down into the opening of the drill pipe section during assembly to start the fluid filling. The method is characterized by that it is used a threadless filling pipe (110) with two main parts defined by an complex upper sleeve (50) and a lower sleeve (52), and that includes mutual intermediate seal surfaces (47,49), and the filling pipe's (110) seal towards the outlet of the fluid delivery system (20), respectively towards the top part (31) of the drill pipe (30) is produced by the weight of the overlying fluid delivery system (20) towards the filling pipe's (10) circular upper and lower seal surfaces (12, 14;
(Continued)

16, 18). It is also discussed a new construction of a filling pipe (110), and the application of the method and the filling pipe.

16 Claims, 4 Drawing Sheets

(58) Field of Classification Search
CPC ..... E21B 21/103; E21B 3/02; E21B 19/08; E21B 21/10
See application file for complete search history.

(56) References Cited

U.S. PATENT DOCUMENTS

2007/0181346 A1 8/2007 Swietlik et al.
2010/0206583 A1 8/2010 Swietlik et al.
2013/0168105 A1* 7/2013 Leman ..... E21B 19/08 166/380
2014/0069660 A1 3/2014 Valenzuela
2014/0224509 A1* 8/2014 Yajure ..... E21B 21/106 166/380
2017/0321508 A1 11/2017 Wiens et al.

FOREIGN PATENT DOCUMENTS

GB 2457287 A 8/2009
WO 2010/089572 A1 8/2010
WO 2010089572 A1 8/2010

OTHER PUBLICATIONS

Search Opinion, Date: CF Form 1507, Sheet: 1, Applicaiton No. 18 748 563.6, EPO Form 1703 01.91TRI, Following Application Documents Filed in Electronic Form on Oct. 3, 2020.

* cited by examiner

METHOD AND DEVICE TO SUPPLY LIQUID TO A DRILL PIPE

SCOPE OF THE INVENTION

The present invention relates to a method for drilling a well through a formation from a drilling installation, for the recovery of fluids, where a drill pipe made up of a number of drill pipe sections is lead down into the formation and is supplied with liquid fluid from a fluid delivery system before one or more new drill pipe sections connected to the installations drill floor successively is screwed onto the upper end of the drill pipe, where there is used a filling pipe formed with a downwardly extending pipe spigot that is lead down into the opening of the drill pipe section during assembly to start the fluid filling as stated in the preamble of the following claim 1.

The invention also relates to a filling pipe as apparent in claim 10.

The invention is particularly applicable for recovery of hydrocarbon containing fluids from formations, but is also applicable for water drilling, such as drilling in underground formations for fresh water or for the exploration of geothermal heat.

In particular the invention is dealing with a new tubular tool for filling of liquid in drill pipe or casing pipe, where there are two different dimensions between the top drives saver sub, and the drill pipe or casing going into the well.

BACKGROUND OF THE INVENTION

There are strict requirements for drilling operations to be safe and effective. Operations taking place on and around the drill floor is always subject to continuous improvements. On every field, also on the Norwegian continental shelf, all activities are logged and analyzed down to seconds. From these analyzes statistical reports are generated that is used in the dialog between the onshore organization and the offshore organization to improve the operations quality on all levels.

It has been found that some operations are inexpedient more time-consuming than necessary. For example the process of filling drill pipe with drilling fluid, when the dimensions of the saver sub in the top drive and the tubular to be conveyed into the well are different.

The background for filling this pipe regularly, as an example every 1000 meters, is that differential pressure occurs between the inside and the outside of the drill pipe when the drill pipe is not filled with drilling fluid. Inside the drill pipe there will be air, because the drill string is not self filling, since there is a check valve installed in the drill string that prevents drilling fluid from entering the drill string from below.

Reference to the Prior Art

Today there are mainly two methods to perform the supply of liquid to the drill pipe:

1. Top filling of drill pipe:

Top drive with saver sub is lowered to just above the drill pipe in the rotary table. The drill pipe is then filled with fluid directly from the saver sub, which is not connected to the drill pipe, with a limited number of liters per minute, since air has to be displaced from the inside of the drill string.

2. Screw in a drill pipe crossover (X/O) on the top of the drill pipe and in the saver sub connected below the drilling machine: the crossover unit is designed with compatible tread dimensions and is mounted between the saver sub and the drill pipe. After the connection is made up fluid can be supplied from above without spills onto the deck.

Problems with Known Technique.

1. Top filling of drill pipe:

The problem with this method is that it is time consuming and that it can produce a lot of spillage on the drill floor and adjacent areas, as mentioned above.

2. Connect a drill pipe crossover (X/O) to the drill pipe and to the saver sub:

For this there will always be need for at least two persons on drill floor, since placing the filling pipe (X/O) into the drill string needs to be done by means of a winch. One person is needed to be responsible for the lift by the winch and another person guiding the filling pipe (X/O) to the top of the drill pipe.

In addition this operation is time consuming, since one needs to make up the drill pipe crossover (X/O) to the drill string and to the saver sub with a predefined torque.

As regards to the state of the art, it should also be referred to the following patent publications US-2014/0069660,US 2007/0181346, WO 2010/089572, US 2010/0206583 and US 2004/0000405.

Object of the Present Invention

It is an object to bring about a new method and a new tool to fill a drill pipe with fluid as the drill pipe is extended with new drill pipe sections.

Further it is and object to bring about a solution without treads where one can use an effective and time saving component during filling the process.

Another object with the invention is to bring about a manually manageable device that quickly can be mounted between the saver sub and the drill pipe, so that fluid can be added to the drill pipe.

It is also an object with the invention to bring about a filling pipe without special sealing rings in connection to the pipe end surfaces which lies against the contact surface of the upper saver sub and respectively the upwardly extending drill pipe. Instead one seeks to exploit the metal to metal seal resulting from the opposing metal surfaces.

SUMMARY OF THE INVENTION

The method according to the invention is characterized by the use of a filling pipe without threads with two main parts defined by an upper sleeve and a lower sleeve, and that includes mutual intermediate seal surfaces, and the filling pipe's seal towards the fluid delivery system, respectively towards the top of the drill pipe is produced by the weight of the overlying fluid delivery system towards the filling pipe's circular upper and lower seal surfaces.

According to a preferred embodiment occurring overpressure is displaced through one or more bleeding channels through the filling pipe's wall parts and which each comprises an overpressure valve which opens for flow outwards at a given fluid overpressure.

According to yet another preferred embodiment it is used an overpressure valve in the form of a burst disc and/or a spring-loaded closing device which normally closes against a seat and by overpressure against the spring force is lead out of the closing position against the seat.

Preferably it is used a filling pipe with stepped annular abutment surfaces to be adapted to the choice of drill pipe sections with different end dimensions.

Particularly preferably it is when occurring overpressure brings the fluid to flow between the two channels through a annular shaped track (a recession) in the outer wall of the upper pipe, or through a track (a recession) in the inner wall of the lower pipe, for the case where the bores/channels is not lining up.

Preferably is use of a filling pipe where the upper and lower abutment surface is equipped with metal seals, or sealing gaskets such as O-rings to improve said seal.

According to yet another preferred embodiment occurring air from the drill pipe is displaced through a channel through the filling pipe's wall. Further to avoid fluid to flow out of the pipe through the air channel when the drill string is filling up towards the supply pipe, a connected float is brought to float to a upper position and close the air outlet channel, while occurring air that later are released down in the drill pipe again leads the float to again sink and open the air outlet channel.

Preferably, it is used a float with a upper seal (lip seal) that abuts the lower edge of a chin in the inner pipe's upper sleeve and produces said sealing and closure of the air outlet channel.

The device according to the invention is characterized by that the filling pipe is threadless, and consist of to pieces and defined by an upper inner sleeve which is jointed with a lower outer sleeve with mutual intermediate ring seals.

According to a preferred embodiment the wall of the filling pipe comprises one or more bleed off channels that preferable is formed with an overpressure valve for diversion of fluid with to high fluid pressure.

Preferably the overpressure valve is a burst disc, or a spring-loaded closing device which normally closes against a seat and by overpressure against the spring force is lead out of the closing position against the seat.

It is particularly preferred if the filling pipe (10) comprises stepped annular abutment surfaces to be adapted to the choice of drill pipe sections with different end dimensions.

Preferably the upper and lower abutment surfaces is equipped with extra annular shaped sealing, such as O-rings.

The filling pipe comprises preferably a channel through the pipe's wall for diversion of air from the drill pipe. The deaeration channel comprises a connected float arranged to be switched between closing position when in contact with drilling fluid, and a deaeration—open position in contact with occurring air released from down inside the drill pipe.

It will appear that the filling process is more efficient by inserting a two piece filling sleeve (also named a SmartSleeve) manually in between the saver sub and the drill pipe. The upper and lower end of the filling pipe do not need to include annular formed sealing elements, but can be pure metal to metal seals which satisfactorily seals the surfaces between the saver sub and the filling sleeve, as well as between the filling sleeve and the drill pipe using the weight the drilling machine exercises.

Since the filling sleeve alternatively can be a plastic pipe, one will achieve a satisfactory plastic-to-metal seal.

The result is that one quickly can insert a SmartSleeve with upper and lower clean end surfaces (metal/plastic), after which saver sub is lowered and the transitions between saver sub and filling pipe respectively filling pipe and newly installed drill pipe is completely sealed. After a sufficient amount of fluid is filled, the operation is performed in the opposite order, where the insertion of new drill pipe sections can proceed.

The filling sleeve according to the invention, which is a threadless X/O, will be an effective and time saving component during filling of drill pipe or casing.

One also achieves a filling sleeve that increases flexibility since it can be used even with variations in drill pipe end dimensions, without having to change the saver-sub dimensions. This applies especially to cases where the pipe section threads are not compatible with the drilling machines saver sub. During a drilling operation it is in fact not uncommon to have different dimensions on the drill pipes. A filling pipe with the mentioned stepped annular abutment surfaces can directly be adapted to different drill pipe dimensions.

DESCRIPTION OF FIGURES

Preferred embodiments of the invention will hereinafter be described in more detail with reference to the accompanying drawings, in which.

DESCRIPTION OF PREFERRED EMBODIMENTS OF THE FILLING PIPE

Figure 1:
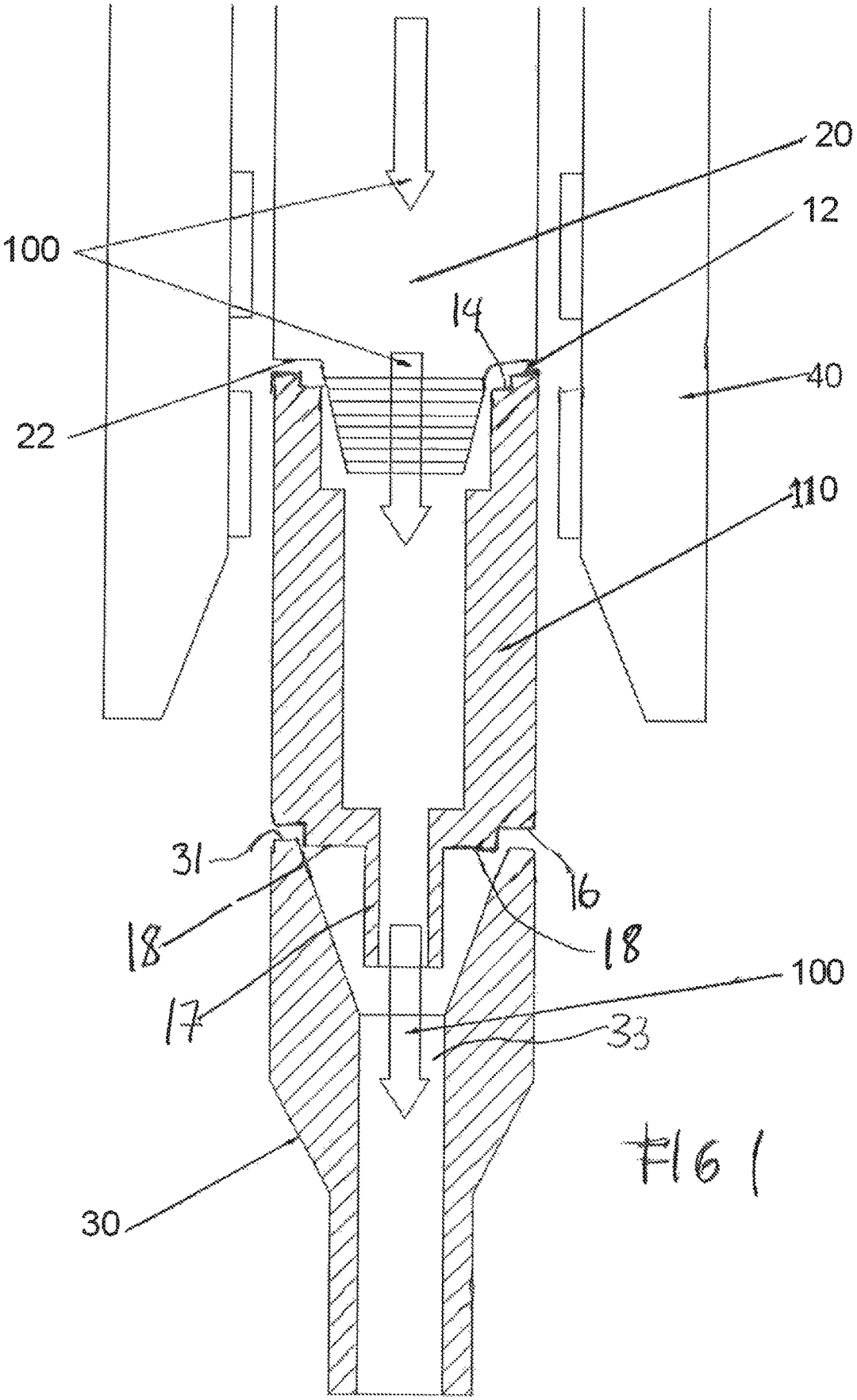
FIG. 1 shows an introductory variant of a filling pipe according to the invention, inserted between the drilling machine and a drill pipe.

Initially, reference is made to FIG. 1 which shows a threadless filling pipe (or—sleeve) 110. The filling pipe is suitable to be inserted between the fluid supply system to a drilling machine 20 and drill pipe 30 to be able to supply drilling fluid (showed with arrow 100) without leakage off drilling fluid. The figure shows the three elements in order, and a torque tool 40 which later is used to screw the saver sub to the top of the drill pipe 30 as showed in the figure. Both ends of the pipe comprises annular formed sealing surfaces, which especially preferred is made up off the pure metal end surfaces 12/14, 16/18. The lower part off the pipe 110 comprises a downwardly extending pipe spigot 17 directed to lead towards the inlet 31 of the drill pipes 30 top part.

The top part of the filling pipe 110 comprises therefor an annular surface 12 oriented to lie against the lower annular surface 22 of the drilling machines saver sub 20. The figure also shows a variant with a second annular shaped shoulder surface 14 placed radially within and below the first annular surface 12, in the form of a step down.

The lower part of the filling pipe comprises also mutual stepped annular surfaces 16, 18, shaped as chins. The annular surface 18 is consequently situated radially within the annular surface 16. FIG. 1 shows how the upper annular surface/surfaces 12,14 in the filling pipe is directed to lie against the end surface 22 of the associated drilling machines saver sub, so that complete sealing is achieved. According to the invention this will give sufficient seal when the pipe is held down due to the saver subs weight. Preferably seal is achieved using pure metal sealing surfaces. According to an alternative embodiment the upper and lower sealing surfaces 12,14,16,18 can if needed be equipped with gaskets such as O-rings to improve said seal.

Further it is showed how the lower annular surface/surfaces 16,18 on the filling pipe is adjusted to lie against the top surface edge 31 associated the drill pipe 30 extending upwards, so that complete sealing is achieved.

Figure 2:
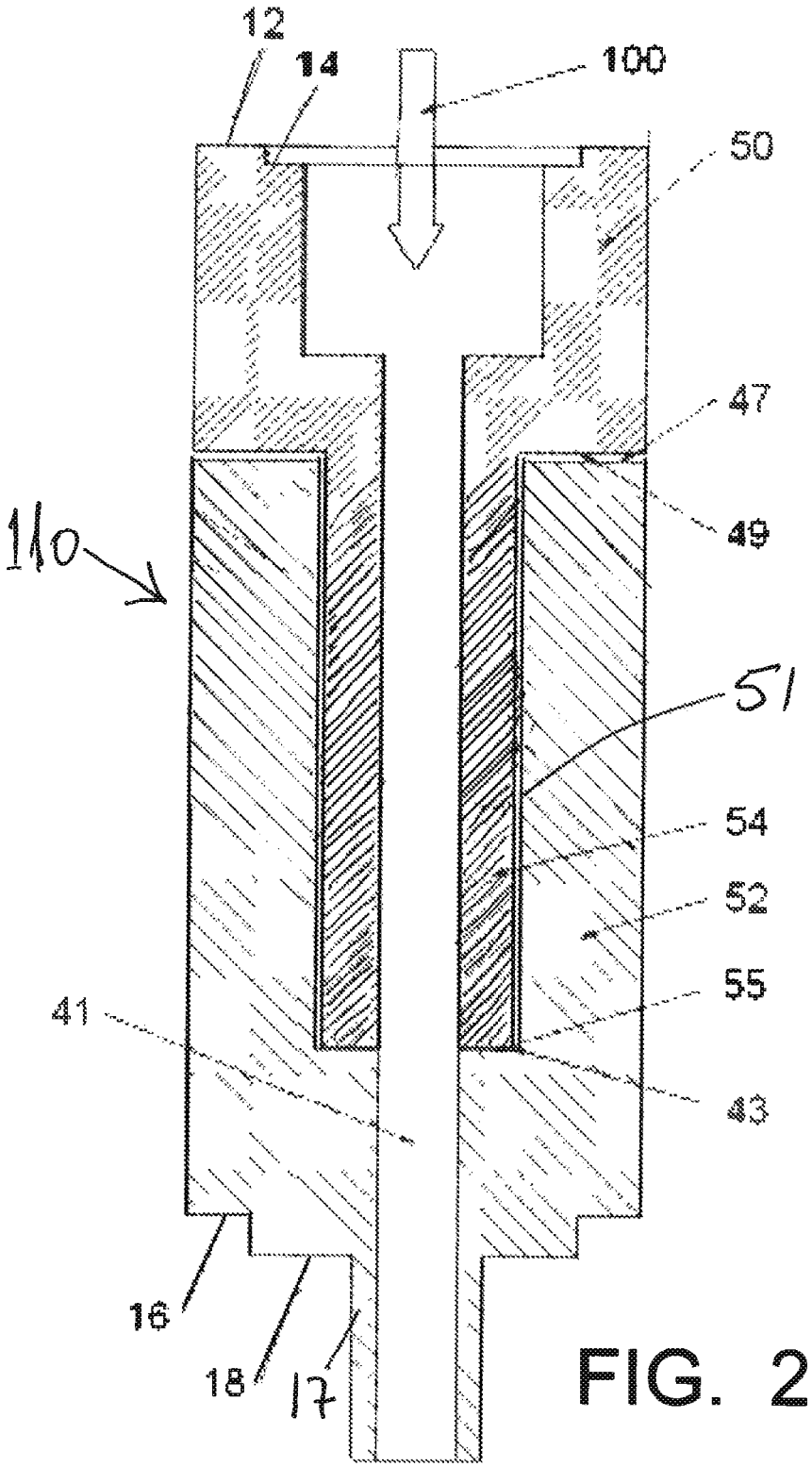
FIG. 2 shows a vertical section of a preferred construction of a filling pipe according to the invention, comprising a construction with two pipe pieces.

FIG. 2 shows a two piece filling sleeve 110 that according to the invention is in the form of an upper 50 respectively a lower sleeve 52. The sleeve 50 constitutes an upper part with upward facing annular surfaces 12 and 14 equivalent to the embodiment in FIG. 1. The lower part of the upper sleeve 50 comprises a downward extending pipe spigot 54 adapted to be brought down inside a channel 41 in the lower sleeve 52. The upper sleeve 50 thus has a T-shaped cross section, while the lower sleeve has a corresponding U-shaped inner channel 51 which accommodates the pipe spigot 54.

The pipe spigot's 54 lower annular surface 43 lies against a shoulder 55 in the bore 51 of the lower sleeve 52. The annular shaped top surface 47 of the lower sleeve 54 forms the sealing abutment against a corresponding chin 49 in the upper sleeve 50.

The upper sleeve 50 is adapted to be screwed into the outer sleeve 52 so that mentioned annular surfaces 47/49 respectively 43/55 is pushed against each other and forms a seal. Alternatively can the two parts 50 and 52 be joined by an interference fit.

For easy manual operation the sleeve is preferably made of light metal, plastic (particular reinforced plastic) or a composite.

Figure 3:
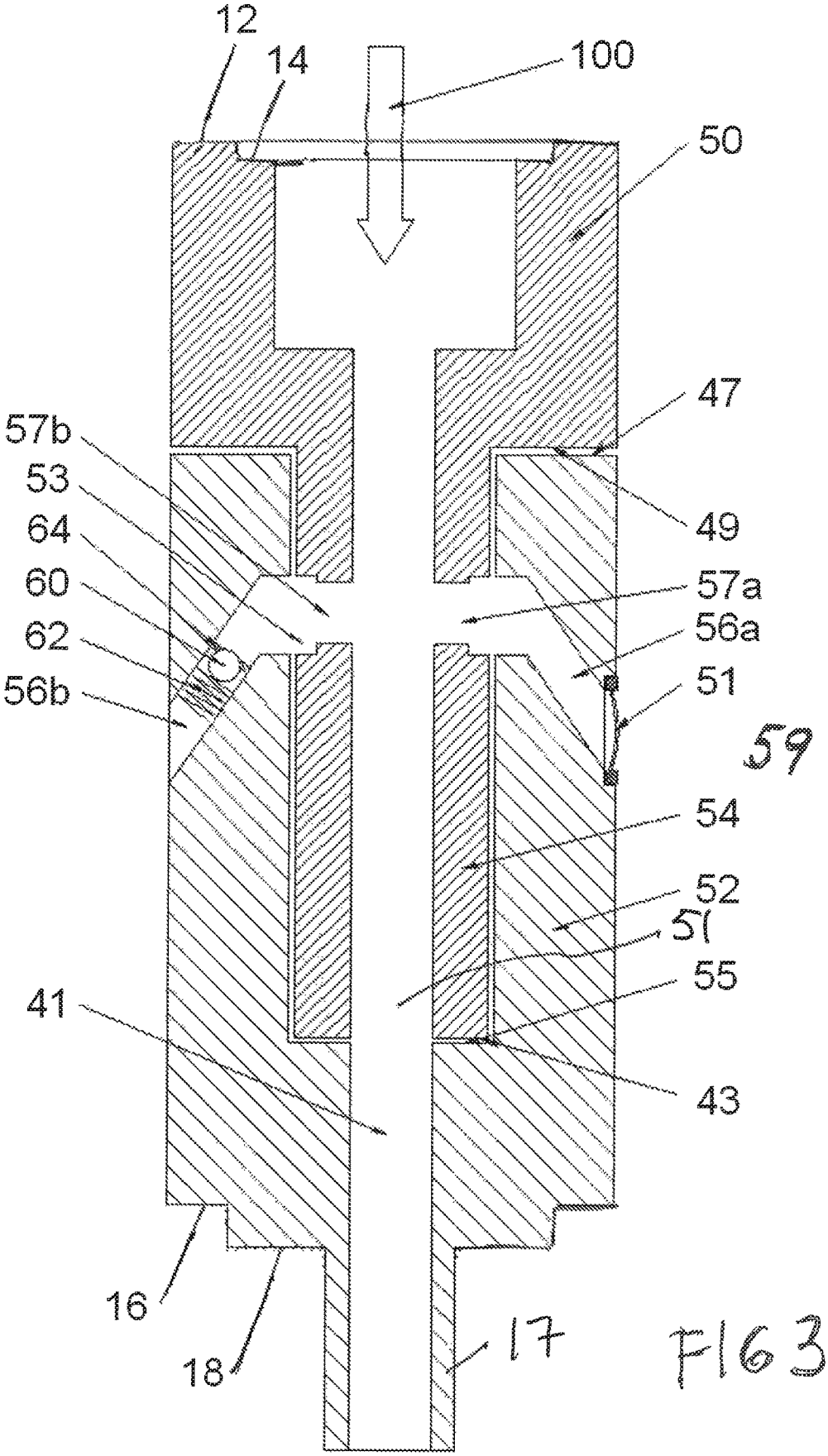
FIG. 3 shows a vertical section off the pipe construction with two pipe pieces from FIG. 2, comprising one or more bleed off channels with overpressure valve, showed in two variants.

A Second Preferred Embodiment of the Filling Pipe According to FIG. 3 Includes a Bleed Off Channel with an Inserted Overpressure Valve.

It is showed in FIG. 3 a construction of a bleed off channel in the feeding pipe 110 to let out fluid if the fluid pressure gets to high. The construction implies that in the pipe 110 is drilled one or more channels through the pipes wall(s) to establish a closable fluid connection, in the form of a channel 56, between the filling pipe's longitudinal inner channel 41 and the area 53 outside the pipe 110. Each channel 56 comprises a valve which initially is closed, but at a given pressure opens the channel to let out fluid (gas) to depressurize the filling system.

In the given example it is showed two channels 56*a*,57*a* respectively 56*b*,57*b* through the two pipe parts 50-52 and to the inside, this is to show two possible pressure-relievers that can lead fluid out when overpressure occurs in the channel 41.

The channel on the figures right side comprises a burst-disc 51 with a plate form that blocks the channel 56*a*. At elevated pressure, burst plate 51 bursts out and opens channel 56*a*.

According to the variant showed to the left on the figure, the channel comprises a barrier ball 60 that by the help of a spring 62 is pushed from the outside and inwards into the channel 56*b* against a annular seat 64, this constitutes a positon where the ball 60 close for flow from the channel 41 in the feeding pipe. If the inner pressure exceeds the force from the spring 62, the ball 60 will be pushed outwards, compressing the spring 62 and the channel opens for fluid flow out through the seat. Both of the two solutions works as a bleed off channel at occurrence of overpressure.

As FIG. 3 shows, the bleeding channel extends obliquely upwards from the outside and through the wall of the lower pipe part 52 and into the channel 57*a* in the pipe wall of the upper pipe part 50 and ends in its inner wall against the duct 41.

As the figure shows, the channel 56 (56*a*, 57*a* and 56*b*, 57*b*) passes through the two pipe walls 52 and 54, and comprises pure circular holes through the walls, one obliquely for further to extend radially through the upper tube 50.

In order to ensure a fluid connection between the two bores, an annular groove 53 (a recess) is provided in the outer wall of the inner pipe 50. Alternatively, such an annular groove or recess may be formed in the inner wall of the lower pipe 52. This for the case where the bores/channels 57*a*-56*a* or 57*b*-56*b* did not completely line up during the mating of upper and lower tubes 50, 52. Then liquid fluid which may flow into the channel will first be introduced into the radial bore, then floating around the annulus 53, to flow further through the duct 56. The two bore holes/bores 57 (57*a* and 57*b*) and 56 "points" thus against a 360 degree milled ring groove 53 in the outer wall of the upper tube 50, i.e. in its extended pipe spigot 54 which extends down into the channel 51. This causes fluid to flow into ring groove 53 until it hits the bore (borehole) 56 and can pass further through the channel and towards the blast disc 51 or ball valve 60.

Ventilation of Air

According to a preferred embodiment, it is formed a second radially directed bleed channel 70*a*, 71*a*; 70*b*, 71*b* through the pipes 50,52 wall parts below the first bleed off channel 56. This channel is intended to ventilate air that flows/is displaced in the drill string as it is filled with drilling fluid. This bore/channel 70*a*, 71*a*, 70*b*, 71*b*, which is angled correspondingly from the outside obliquely upwardly through the lower pipe 52, then with an angle downwards through the extension spigot of the upper pipe 50 and is fully open for the outflow of the air.

Figure 4:
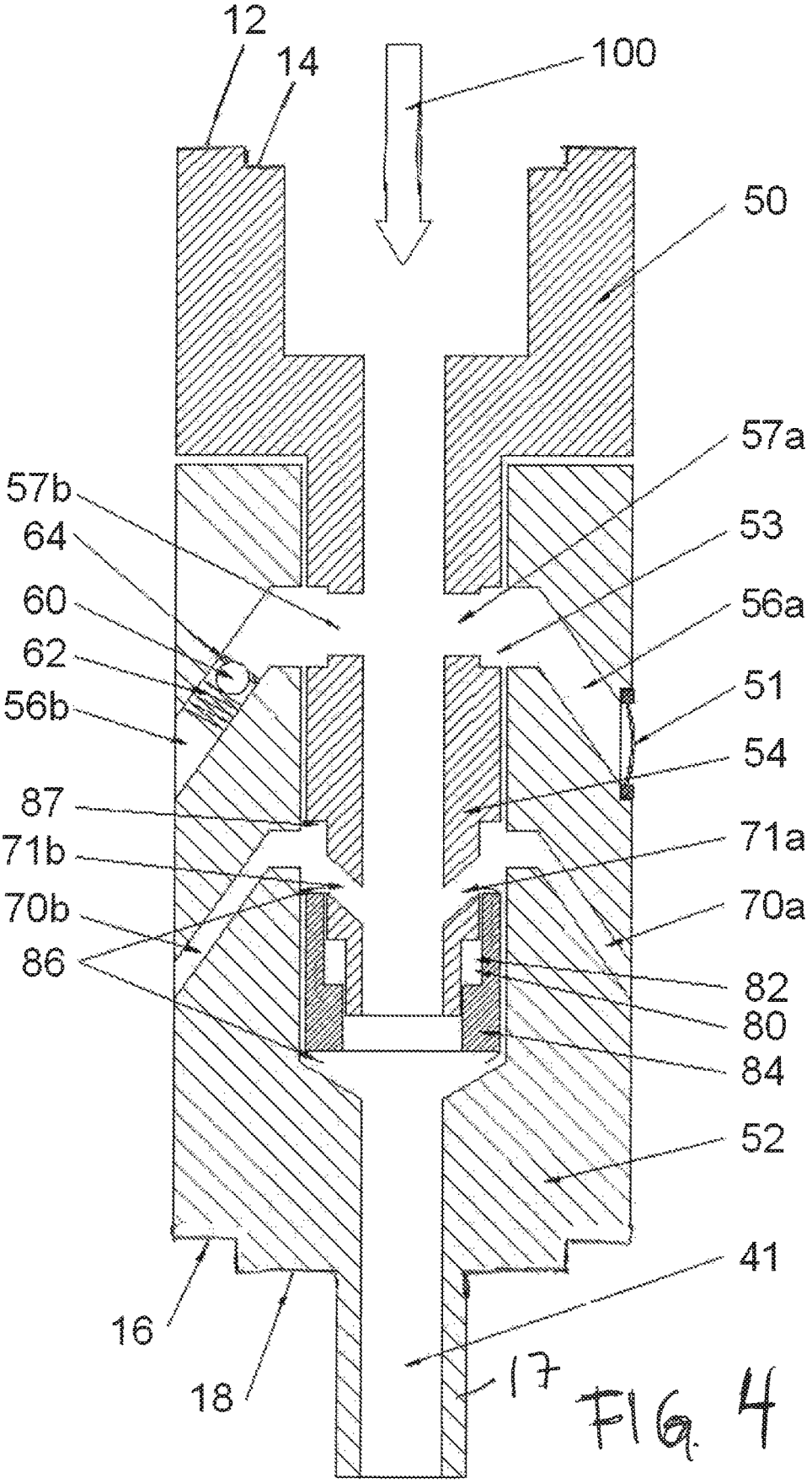
FIG. 4 shows a vertical section of yet another variant, where there in addition to the bleed off channel in FIG. 3 is formed a deaeration channel through the two pipe walls.

To avoid outward flow of fluid through the same air-bore/channel 70*a*,71*a*; 70*b*,71*b* and out on the drill floor area on the platform, a float valve is installed adjacent to the channel 70*a*,71*a*; 70*b*,71*b*. This is showed in FIG. 4 in a third variant of the filling sleeve.

If/when the fluid level rises upwards to the same level as the channel 70, it will flow out through the channel and out on the drill floor and spill the working areas of the operators. That is way it is formed an annular stepped recession 80 around the whole circumference of the pipe part 54. The recession 80 defines together with the inside of the outer sleeve 52 an annular space 82 in which an annular float 84 (floating ring), is mounted. This assembly is formed adjacent to the bottom of the inner sleeve 50 so that it is exposed to the inner channel 41 further down through the supply pipe towards the drill pipe. The float is formed in a material with lower density than the fluid that is filled in the pipe, and which gives the rising fluid level in the drill pipe. On the upper an lower circumferential surfaces of the float i.e. the surfaces that shall form the seal in upper respectively lower position, is formed as compressible sealing elements 86 in the form of so called elastic lip seals.

The float 84 is further of a form corresponding to the defined space 82 but it is shorter in axial direction, so that it can function as a glide/slide with a space for movement up and down in axial direction i.e. to slide up and down axially. In its upper position it covers completely the channel 70 and fully closes for flow through this channel 70.

When the drill string is filled with fluid up to the supply pipe, the float will float to its upper position when the fluid level reaches this point, this results in that the channel with the upper part of lip seal that abuts the lower edge of the chin 87 in the inner pipe 50, and prevents fluid from flowing out from the pipe and contaminate the work deck of the operators. When the air pockets down in the drill pipe gradually is released and flows upwards the float will, in contact only with air, sink down again to its down position, and will open the channel 70 for flow since the float materials density is higher than that of air. Air can then flow out through the channel 70*a*,71*a*;70*b*,71*b*.

A favorable consequence of this is that one can pump fluid downward with pressure through this supply pipe that do not need threaded connection with the drill pipe or the filling machinery.

The invention claimed is:

1. A method of drilling a well through a formation from a drilling installation, for the recovery of fluids, where a drill pipe made up of a number of drill pipe sections is conducted down into the formation and is supplied with liquid from a fluid delivery system before one or more new drill pipe sections connected to a floor of the drilling installation are successively screwed onto the upper end of the drill pipe; wherein the method comprises:

placing a threadless filling pipe formed with a downwardly extending pipe spigot in an opening of said drill pipe section prior to commencing said supply of the liquid;

wherein the threadless filling pipe comprises a complex upper sleeve and a lower sleeve having respective intermediate annular sealing surfaces;

placing a fluid delivery system having weight on top of the filling pipe, whereby the weight of the fluid delivery system on annular upper and lower sealing surfaces of the filling pipe and on an upper portion of the drill pipe provides a sealed connection between the fluid delivery system, the filling pipe, and the drill pipe; and if the fluid pressure in the filling pipe exceeds a first predetermined pressure, displacing the liquid in the filling pipe through one or more liquid bleed-off channels that are disposed through a downwardly extending pipe spigot of the upper sleeve and the lower sleeve, wherein each of said one or more liquid bleed-off channels comprises a pressure relief valve.

2. The method according to claim 1, wherein the pressure relief valve comprises a burst disc and/or a spring-loaded closing device which in a non-actuated state closes against a seat in said one or more liquid bleed-off channels.

3. The method according to claim 1, wherein the filling pipe comprises stepped annular abutment surfaces configured to adapt to drill pipe sections with different end dimensions.

4. The method according to claim 1, wherein, if the fluid pressure in the filling pipe is above a second predetermined pressure, the liquid in the filling pipe is flowed through the one or more liquid bleed-off channels and out of the filling pipe.

5. The method according to claim 1, wherein said annular upper and lower sealing surfaces comprise respective annulus-shaped sealing members.

6. The method according to claim 1, wherein air in the filling pipe is evacuated via one or more air bleed-off channels through a wall in said filling pipe.

7. The method according to claim 6, wherein a float is arranged to float up into an upper position inside the filling pipe and to close said one or more air bleed-off channels, while air that is released down in the drill pipe causes the float to drop and open the said one or more air bleed-off channels, whereby fluid flow through said one or more air bleed-off channels when the filling pipe is filled with the liquid is avoided.

8. The method according to claim 7, wherein said float comprises an upper seal that abuts the lower edge of a chin portion disposed on the downwardly extending pipe spigot of the upper sleeve and thus seals said one or more air bleed-off channels of the filling pipe.

9. A filling pipe for supply of liquid from a fluid delivery system to a drill pipe, wherein the filling pipe comprises:

annular upper and lower sealing surfaces and a pipe spigot to be inserted into an opening of a section of said drill pipe; wherein the filling pipe is threadless, and comprises an upper inner sleeve which is joined with a lower outer sleeve having respective annular intermediate sealing surfaces; and wherein the filling pipe comprises one or more liquid bleed-off channels arranged through a portion of a wall of the filling pipe.

10. Use of the method according to claim 1 or the filling pipe according to claim 9, for on-site recovery of hydrocarbons containing liquids from formations, for water drilling.

11. The filling pipe according to claim 10, wherein the one or more liquid bleed-off channels comprise one or more pressure relief valves for diverting the liquid at pressures above a predetermined value.

12. The filling pipe according to claim 11, wherein said pressure relief valve is a burst disc, or a spring-loaded closing device which in a non-actuated state closes against a seat in said one or more liquid bleed-off channels.

13. The filling pipe according to claim 10, further comprising stepped annular abutment surfaces configured to adapt to drill pipe sections with different end dimensions.

14. The filling pipe according to claim 10, wherein the annular upper and lower sealing surfaces comprise respective annulus-shaped sealing members.

15. The filling pipe according to claim 10, wherein the filling pipe comprises one or more air bleed-off channels arranged through a portion of the filling pipe wall, for diversion of air from the drill pipe.

16. The filling pipe according to claim 15, wherein each of the one or more air bleed-off channels comprises an affiliated float adapted to be pushed and switched between a closing position for the liquid, and an open position when in contact with air present in the drill pipe.

* * * * *